US005819145A

United States Patent [19]

Tanaka et al.

[11] Patent Number: 5,819,145

[45] Date of Patent: Oct. 6, 1998

[54] IMAGE FORMING DEVICE FOR FORMING A UNIFORM TONER LAYER ON A DEVELOPING ROLLER

[75] Inventors: Yoshiaki Tanaka; Shigekazu Enoki, both of Kawasaki; Iwao Matsumae, Musashino; Hiroshi Hosokawa, Yokohama, all of Japan

[73] Assignee: Ricoh Company, Ltd., Tokyo, Japan

[21] Appl. No.: 688,770

[22] Filed: Jul. 31, 1996

[30] Foreign Application Priority Data

Jul. 31, 1995 [JP] Japan ..... 7-195335
Jul. 31, 1995 [JP] Japan ..... 7-195336

[51] Int. Cl.[6] ..... G03G 15/09

[52] U.S. Cl. ..... 399/274

[58] Field of Search ..... 399/274, 284, 399/222, 252, 260, 265, 267, 279, 273, 272, 281, 283, 66, 262

[56] References Cited

U.S. PATENT DOCUMENTS

| | | | |
|---|---|---|---|
| 4,406,536 | 9/1983 | Suzuki et al. . | |
| 4,733,267 | 3/1988 | Enoki et al. . | |
| 4,866,480 | 9/1989 | Hosoya et al. | 399/284 X |
| 4,885,223 | 12/1989 | Enoki et al. . | |
| 5,149,914 | 9/1992 | Koga et al. . | |
| 5,519,472 | 5/1996 | Ojima et al. | 399/274 |
| 5,552,867 | 9/1996 | Sekino et al. | 399/284 |
| 5,557,380 | 9/1996 | Maeda et al. | 399/260 |
| 5,570,166 | 10/1996 | Ohzeki et al. | 399/274 X |
| 5,592,265 | 1/1997 | Sakuraba et al. | 399/283 X |
| 5,623,717 | 4/1997 | Takenaka et al. | 399/281 |
| 5,659,843 | 8/1997 | Takano et al. | 399/66 |
| 5,671,461 | 9/1997 | Ishii | 399/262 X |
| 5,702,812 | 12/1997 | Bracken et al. | 399/274 X |

FOREIGN PATENT DOCUMENTS

| | | |
|---|---|---|
| 62-17774 | 1/1987 | Japan . |
| 62-75563 | 4/1987 | Japan . |
| 4-55876 | 2/1992 | Japan . |

*Primary Examiner*—S. Lee
*Attorney, Agent, or Firm*—Oblon, Spivak, McClelland, Maier & Neustadt, P.C.

[57] ABSTRACT

An image forming device which allows reducing a linear velocity ratio of a developing roller against a sensitive body, which enables a pole pitch of a magnetic field generating layer to be miniaturized, and which generates a uniform and adequately thick toner layer on the developing roller. A toner regulating element formed by a sheet metal material having elasticity and non-magnetic characteristics elastically contacts a surface of the developing roller. The developing roller has an elastic body layer and a magnetic field generating layer having a minute pole pitch. The toner regulating elements serves to regulate a thickness of the toner layer without vibration induced from the pole pitch of the magnetic field generating layer. Thus, the toner layer can be uniform and of an adequate thickness, and reducing the linear velocity ratio of the developing roller against the sensitive body does not generate any drawbacks.

32 Claims, 8 Drawing Sheets

IMAGE FORMING DEVICE FOR FORMING A UNIFORM TONER LAYER ON A DEVELOPING ROLLER

BACKGROUND OF THE INVENTION

1. Field of the Invention

The present invention relates to an image forming device for laser printers, copying machines, facsimiles, and the like, to develop electrostatic latent images on a sensitive body.

2. Discussion of the Background

In image forming devices which form images using electrophotographic processes, various types of developing methods are used. One developing method using one component magnetic toner is illustrated in FIG. 6. As shown in FIG. 6, in a developing device 1, a developing roller 2 is arranged and is installed to be rotated freely. This developing roller 2 is a rigid roller, e.g. JIS A hardness greater than 70°, having a magnetic field generating layer 4 in which N and S poles are formed alternately on an outer circumference of a metal core 3. One component magnetic toner 6 in a toner hopper 5 is supplied to a surface of the developing toner 2 by the magnetic force of the magnetic field generating layer 4 through a supplying roller 7.

A tip edge 8*a* of a developing blade 8 contacts the developing roller at a point downstream from the supplying roller 7. The developing blade 8 is a sheet shaped metal blade having elasticity and magnetism. The toner 6 is conveyed by the magnetic field generating layer 4 of the developing roller 2 and is regulated to a thin layer of uniform thickness on the developing roller 2 by the tip edge 8*a* of the developing blade 8. The toner is then conveyed to the sensitive body 9.

By this operation, the toner is provided to develop an electrostatic latent image on the sensitive body 9. At this time, because it is necessary to form a specified touching nip, a touching nip is maintained by forming the sensitive body 9 as a belt pressed against the rigid developing roller 2. Thus, the belt sensitive body 9 is constructed to be supported by, for example, three rollers 10, 11 and 12. Further, an appropriate developing bias is applied by the developing bias power source 13 on the developing roller 2.

However, the device as shown in FIG. 6 suffers from some significant drawbacks. More specifically, as a hard developing roller 2 is utilized, the sensitive body 9 must be formed as a belt to form the required touching nip portion. The use of such a belt sensitive body 9 thereby requires rollers 10–12 to support such a belt sensitive body 9. As a result, it is also required to implement controls to drive the rollers 10–12 and to prevent any deviations in the positioning of such rollers 10–12. This results in the disadvantages of requiring a high cost and a large scale device in layout. Also, forming the belt sensitive body 9 itself is expensive as the substrate of such a belt sensitive body 9 is often formed of Ni.

Also, the magnetic field generating layer 4 of developing roller 2 typically has a pole pitch of 1.3 mm and a flux density of 25 mT (250 gauss). Because the pole pitch and flux density (surface flux density) are relatively large, a sufficient volume of toner can be essentially maintained on the surface of the magnetic field generating layer 4. However, the large pole pitch influentially results in a thickness in the toner layer on the surface of the magnetic field generating layer 4 being uneven, which causes the volume of electrostatic charge to not be stabilized. Consequently, the use of tip edge 8*a* of the developing blade 8 allows the toner layer to be thinner so that it can be in the state of a single layer, if possible. For this reason, the developing blade 8 includes magnetized stainless sheet spring materials, such as, for example, SUS420-J2, of 0.1 mm in thickness. The use of developing blade 8 allows a uniform, but thin, toner layer to be formed on developing roller 2. As a result, a volume of toner which can be maintained on the surface of the magnetic field generating layer 4 is small, i.e., about 0.3 mg/cm$^2$.

In this way, the use of the developing blade 8 results in the toner layer formed on the developing roller 2 being thin. The result of this is that a low image density is achieved and a striped pattern image may result by virtue of vibration of developing blade 8.

To secure a volume of toner of about 0.8 mg/cm$^2$, which is generally preferred on the sensitive body 9, the developing roller 2 may be rotated at a high speed so that the linear velocity of the developing roller 2 is in a range of three to four times as fast as the linear velocity of sensitive body 9. Such a high speed rotation of developing roller 2 allows the toner to be transferred to the sensitive body 9 with a lower pitch, as a result of dividing the pitch of the toner layer corresponding to the large pole pitch by the linear velocity ratio. This has the benefit of avoiding generating a noticeable striped pattern image. In other words, raising the linear velocity of developing roller 2 to four times as fast as the linear velocity of sensitive body 9 causes the effective pole pitch of magnetic field generating layer 4 to be 0.325 mm, which prevents generating a noticeable striped pattern image.

However, developing an image by rotating the developing roller 2 at a high speed, while allowing forming toner as a single layer, has the detrimental result on the image that the image quality deteriorates by deviating the toner, resulting in generating narrowing vertical lines near a crossing of vertical and horizontal fine lines, or extremely emphasizing a rear edge of a solid image. This toner deviation phenomena is further discussed below. Such a device also suffers from drawbacks as a result of using a straight blade 8.

FIG. 8 illustrates use of a straight blade 8. As shown in FIG. 8, a minute space C is formed between a straight tip edge A of blade 8 and an outer circumference B of the developing roller 2. A size of the minute space C determines a volume of toner T passing through the blade 8, and regulates the toner on the developing roller 2 to be a layer of predetermined thickness. Therefore, it is very important for stable controlling of the regulated toner layer to stably control the minute space C. In mass production of such developing units by constructing a variety of parts, the toner layer cannot be regulated stably unless the minute space C is controlled accurately. Accordingly, in a case of setting this type of blade 8, careful attention is required for setting the blade 8 at an accurate position in the developing unit, for example, a blade holder must be set at a predetermined position in relation to the developing roller 2.

If the blade 8 is not carefully positioned, the blade 8 is often set at a position 8' (illustrated by the dotted line in FIG. 8). The space C formed between the blade 8 and the outer circumference of developing roller 2 then becomes larger than in the case in which the blade 8 is set at the predetermined proper position. As a result, a large amount of toner passes through the contacting position, which causes a deterioration of image quality and polluting of the image forming apparatus with toner because of a lack of toner charging. On the other hand, in case of a smaller space C, namely in case of small amounts of passing toner, the image density of a copy deteriorates.

Further, in the device of FIG. 6, with the high speed rotation of developing roller 2 the toner layer on the developing roller 2 may have an uneven thickness because of the vibration of the developing blade 8 having magnetism, which may then lead to the blade vibrating in synchronization with the magnetic poles of the magnetic field generating layer 4.

Meanwhile, according to the Patent Official Journals Nos. Toku-Kai-Hei-3-259278, 4-21881, and 4-181970, a developing method using a flexible developing roller having an elastic inner layer (for example, not more than 70° in JIS A hardness) and a magnetic field generating outer layer is described. In particular, according to the Journal No. Toku-Kai-Hei-4-21881, a method to miniaturize a minimum magnetizing inversion pitch (pole pitch) to less than 100 $\mu$m is described, which keeps the toner layer even by installing an elastic and magnetic developing blade to be pressed against and to contact a surface of the developing roller.

FIG. 7 shows an embodiment of the construction of the developing device as described in the Patent Official Journal No. TokuKai-Hei-4-21881. As shown in FIG. 7, the developing roller 16 is arranged and installed in an opening of developing device case 15 and is formed in a roller shape by laminating an elastic layer 18 and magnetic field generating layer 19 on a base 17. A minimum magnetizing inversion pitch of the magnetic field generating layer 19 which maintains and conveys one component magnetic toner 20 does not exceed 100 $\mu$m. The thickness of the toner layer is regulated by an elastic blade (developing blade) 21 formed of a soft magnetic material to press against and contact the outer circumference (the surface of magnetic field generating layer 19) of developing roller 16. An electrophotoconductor (EPC) formed as a drum type sensitive body 22 is pressed and contacted by the developing roller 16 having flexibility. Further, a developing bias is applied on the developing roller 16 by the developing bias applying method 23.

However, this device as shown in FIG. 7 also suffers from significant drawbacks. More particularly, in this device as shown in FIG. 7 a uniform but thin toner layer is formed on the developing roller 16. As a result, a low density image may be generated. Further, such a device as shown in FIG. 7 suffers from the same problems of toner deviation and of utilizing a straight blade as discussed above with respect to FIG. 8, particularly if the rotational speed of the developing roller 16 is increased.

Such toner deviation is a phenomena, which is now further explained, in which developed toner on a electrostatic latent image on an electrophotoconductor (herein EPC) is deviated at a rear edge in an upstream side of a moving direction of the EPC. The toner deviation is particularly noticeable in a wide area image because of a difference of the developed toner volume between a center and a rear edge of the image. This toner deviation phenomena occurs in a case that a linear velocity of an outer circumference of a developing roller is faster than that of the EPC in a reversal development process.

The mechanism of generating the toner deviation is believed to be as follows. The toner on the developing roller receives kinetic energy parallel to the surface of the EPC by rotation of the developing roller. Therefore, a force parallel to the surface of the EPC acts on the toner on the developing roller in addition to the acting attractive force caused by the potential difference between the EPC and the developing roller.

In a reversal development process, a surface potential of a latent image on the EPC is about −100V, which is decreased by an image-wise exposure from an initial surface potential of about −750V, so that negative charged toner is attracted to the latent image. An adhesive force is the repulsion which is generated between the negative charged toner and the developing roller biased to about −400V. The surface potential of the latent image area is higher than that of the developing roller by about 300V, which means that the repulsion between the negative charged toner and the developing roller is larger than that between the negative charged toner and the latent image, so that the negative charged toner is attracted to the latent image. On the other hand, the surface potential of the non-image area is about −750V, and is lower than that of the developing roller by 350V, which means that the repulsion between the negative charged toner and the non-image area is larger than that between the negative charged toner and the developing roller, so that the negative charged toner is not attracted to the non-image area. As mentioned above, in the reversal development process the toner is always receiving the repulsion from both the developing roller and the EPC. Accordingly, when a force whose direction is parallel to the surface of the EPC acts on the toner, the toner moves easily on the surface of the EPC.

FIG. 9 illustrates in further detail the toner deviation phenomena in which the EPC drum 22 rotates clockwise and a developing roller 19 rotates counterclockwise. As shown in FIG. 9, the moving directions of the EPC drum 22 and the developing roller 19 are the same at the contact point CP of the EPC drum 22 and developing roller 19. FIG. 9 shows a point in which a rear edge RE of an image has just left the contact point CP between the EPC drum 22 and the developing roller 19. The toner T is held sparsely on the developing roller 19, but when the moving speed of the developing roller 19 is faster than that of the EPC drum 22, the image area on the surface of the EPC drum 22 is densely filled with toner T.

However, when the moving speed of the developing roller 19 increases to be greater than two times that of the EPC drum 22, the toner T which has just passed through the contact point CP gathers at a rear edge RE of the image, which is followed by non-image area CA, because the non-image area CA attracts no toner T. Accordingly, the rear edge RE of the image is filled by larger amounts of toner T than the front edge FE of the image. This toner deviation mechanism results in a deterioration of a printed image.

An abnormal image quality of a so-called "edge effect" is similar to this toner deviation phenomena. The edge effect means that an edge part of an image is emphasized by the adhesion of larger amounts of toner than at a center of the image because an electric field of the edge portion of the image is higher than at the center of the image. Therefore, the edge effect is different from the toner deviation in which only the rear edge is emphasized.

SUMMARY OF THE INVENTION

Accordingly, one object of the present invention is to provide a novel image forming apparatus which overcomes the drawbacks discussed above in the background art.

One more specific object of the present invention is to provide an image forming apparatus which can form a uniform toner layer on a developing roller.

A further specific object of the present invention is to provide a novel image forming apparatus in which the uniform toner layer formed on the developing roller has an adequate thickness.

A further specific object of the present invention is to provide a novel image forming apparatus which avoids toner deviation on a developing roller.

A further object of the present invention is to provide a novel image forming apparatus which achieves its objectives with a simple and inexpensive structure to implement.

To achieve such objects of the present invention, the present invention is directed to an image forming device which includes an electrophotoconductive member on which an electrostatic latent image is formed. A developing roller, which includes an elastic body and a magnetic field generating layer overlaying the elastic body layer and which has a predetermined pitch of magnetic poles, contacts the electrophotoconductive member at a contacting section and develops the electrostatic latent image by conveying toner to a surface of the electrophotoconductive member. An elastic toner regulating blade which has a bending section at one end is also provided. This elastic toner regulating blade regulates a thickness of a toner layer on the developing roller by the bending section elastically contacting a surface of the developing roller at a contact point. In the present invention this contact point is upstream, in a rotating direction of the developing roller, from the contacting section of the developing roller and the electrophotoconductive member.

As a further feature of the present invention, the contacting point of the developing roller and the bending section may also be upstream from an intersection of an extension of an installed line of the toner regulating blade and an outer circumference of the developing roller. This contact point may also further be downstream from an intersection of an extension of a vertical line from a center of the developing roller to the extension of the installed line of the toner regulating blade in the outer circumference of the developing roller.

As a further feature of the present invention, an agitator may be provided to supply toner to the developing roller. Such an agitator may be positioned upstream of the contact point of the developing roller and the toner regulating blade and a rotational speed of the agitator may be higher than a rotating speed of the developing roller.

As further features of the present invention, a rotating speed ratio of an outer circumference of the developer roller to an outer circumference of the electrophotoconductive member may be less than 2.0, and the electrophotoconductive member may be a drum having a JIS A hardness less than 70°.

DESCRIPTION OF THE PREFERRED EMBODIMENTS

Figure 1A:
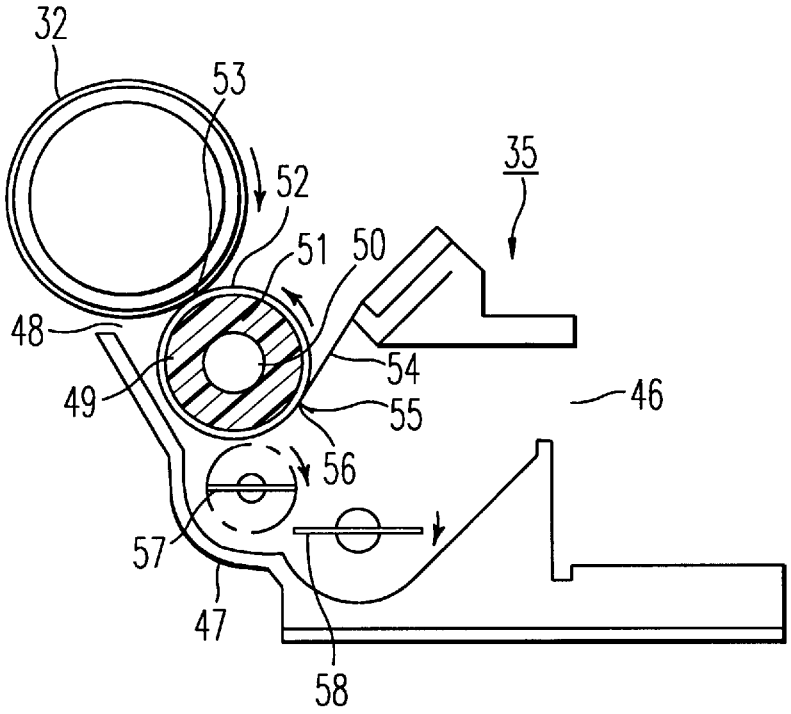
FIGS. 1(*a*)–1(*c*) show a developing unit of a preferred embodiment according to the present invention.

Referring now to the drawings, where like reference numerals designate identical or corresponding elements throughout the several views, FIG. 1 through FIG. 5 illustrate preferred embodiments of the present invention. An image forming device according to the present invention is applied to an electrophotographic recording device 31 as outlined in FIG. 2 as an embodiment.

Figure 2:
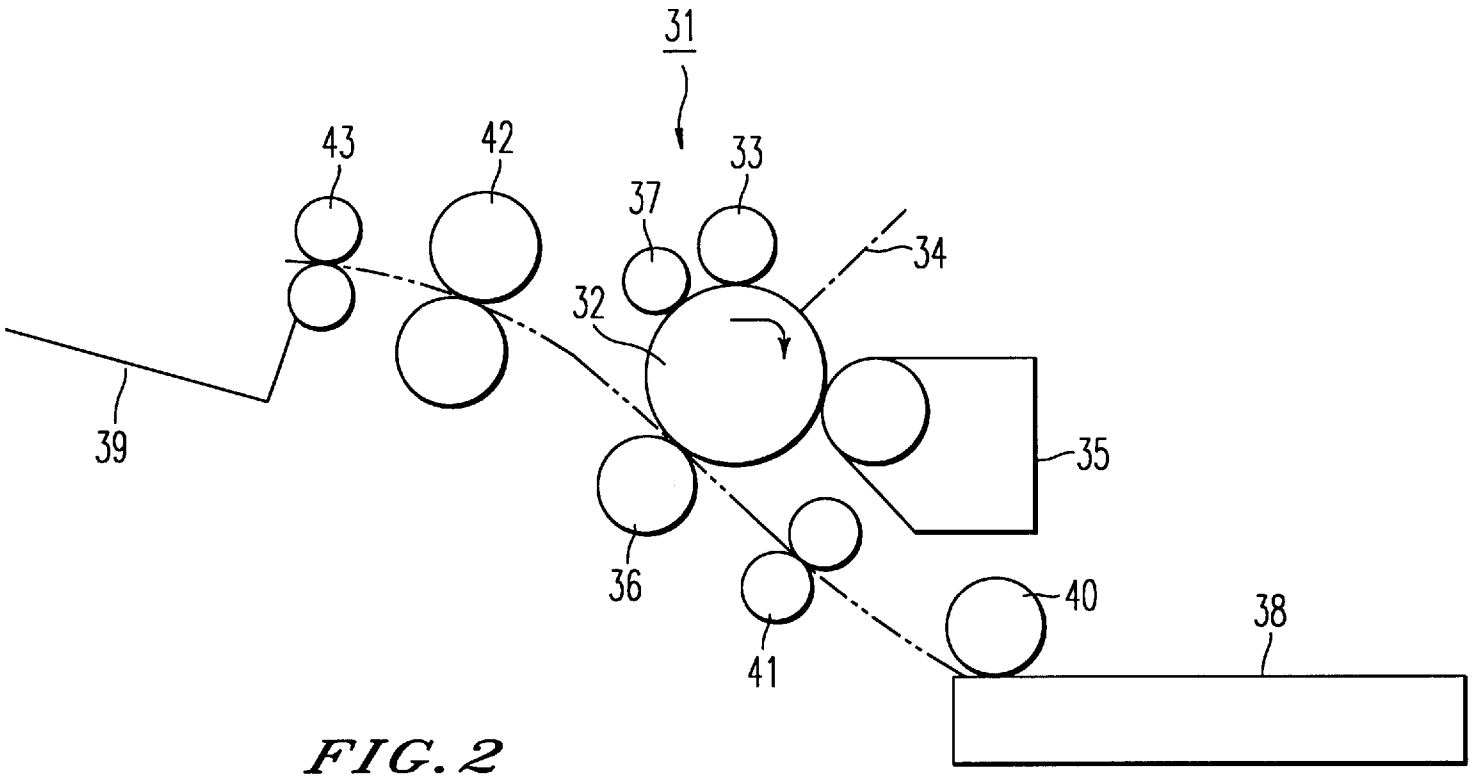
FIG. 2 is a front schematic view showing an entire layout construction of an electrophotographic recording device according to the present invention.

The electrophotographic recording device 31, as shown in FIG. 2, includes a drum type sensitive body 32 as a main body, an electric charging element 33, an optical writing element 34, a developing unit 35, a duplicating element 36, and a cleaning roller 37. Also, a paper feeding passage to pass an image forming medium, e.g., paper, through the duplicating positions on the sensitive body 32 is formed between a paper feeding cassette 38 and a paper tray 39. A paper feeding roller 40, a registration roller pair 41, a fixing roller pair 42 and a paper feeding roller pair 43 are arranged and installed along the paper feeding passage. For the sensitive body 32, a body of a small scale may be used, and thus the entire electrophotographic recording device can be miniaturized.

In the operation of this device according to the present invention, a sheet of duplicating paper (not illustrated) supplied by paper feeding roller 40 from paper feeding cassette 38 is conveyed to duplicating positions of the sensitive body 32 by the registration roller pair 41. Meanwhile, the sensitive body 32 is rotated and driven clockwise, and the surface of the sensitive body 32 is totally charged by electric charging element 33. Then, an electrostatic latent image is formed on the surface of the sensitive body 32 by illumination by a light beam from the optical writing means 34. This electrostatic latent image then forms a visible toner image by developing with toner when passing through the developing unit 35. The visible toner image is then transferred to the duplicating paper conveyed by the registration roller pair 41 to the duplicating positions by the action of the duplicating element 36. The duplicating paper already having the duplication formed thereon is then fed to the paper tray 39 by the paper feeding roller pair 43 after the fixing action by the fixing roller pair 42.

Figure 1B:
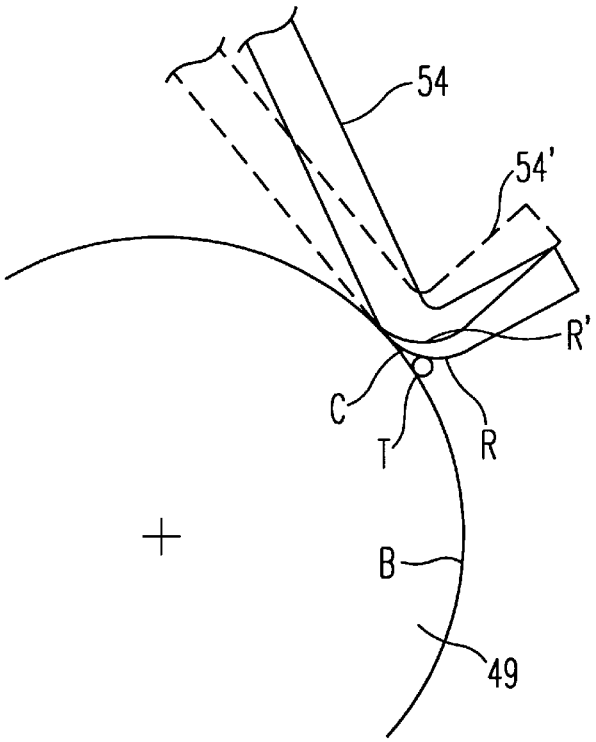
Figure 1C:
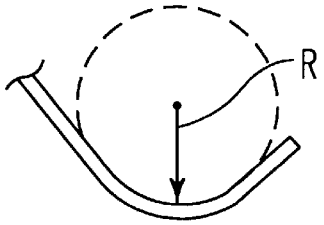

The developing unit 35 of the present invention is described in greater detail in FIGS. 1(*a*)–1(*c*). As shown in FIG. 1(*a*), the developing unit 35 develops an electrostatic latent image on the sensitive body 32 using, for example, one component magnetic toner. A developing roller 49 is installed in a position of an opening 48 adjacent to the sensitive body 32 in a developing container 47. Toner is supplied to developing container 47 from a toner hopper (not illustrated) through an opening 46. The developing roller 49 is a roller formed by a thick elastic body layer 51 covering an outer circumference of metal core 50, and a thin flexible magnetic field generating layer 52 covering a surface layer of the elastic body layer 51.

A contact section 53 as a developing nip is formed by the developing roller 49 pressing against and contacting the surface of the sensitive body 32. The contact section 53 is positioned, as an example, in a lower position diagonally to the sensitive body 32. The developing roller 49 is supported axially in a freely rotating state, and is rotated and driven counter-clockwise by a driving transmission system (not shown). The elastic body layer 51 may be formed by a material having an elasticity less than 70° (JIS A hardness). Also, magnetically attached and parallel N and S poles of a striped type are formed along a shaft line of developing roller 49 with a minute magnetic pole pitch (preferably 0.3 to 0.65 mm).

Further, on the developing roller 49 a specified developing bias (e.g., a value of nearly a medium between a charged electric potential of the sensitive body 32 and an exposing potential) is applied through the metal core 50.

Also, a developing blade 54 softly contacts the surface of the developing roller 49 and is installed at a point upstream of the rotating direction of developing roller 49 from the contact section 53. The developing blade 54 serves as a toner regulating element to regulate a thickness of the toner layer on the surface of the developing roller 49, and is formed by a metal or resin sheet material having elasticity and non-magnetic characteristics, and favorably by a metal sheet spring material. As concrete examples, the developing blade 54 may be formed by metal sheet material such as SUS301 or SUS304, etc. of 0.1 to 0.15 mm thickness.

The developing blade 54 is supported diagonally downward by a part of the developing container 47 on an upper side of the opening 48 so that a bottom side of developing blade 54 elastically and softly touches and contacts a surface of the developing roller 49 from a counter direction (which means a direction to which something enters into from a counter direction against the rotating direction). As a further feature of the present invention, on a bottom side of the developing blade 54, a bending section 55, for example of about of 2 mm, is formed to be bent outwardly at about 90°. An outer circumference of the bending section 55 can be formed as a softly touching and contacting section 56 to the developing roller 49.

FIGS. 1(*b*) and 1(*c*) show further details of the present invention of the developing blade 54 contacting the developing roller 49. As shown in FIG. 1(*c*), the radius of curvature R of the bending section 55 may be about 0.3 mm or larger, or favorably 0.3 to 0.5 mm. Also, the bending angle of the bending section 55 is particularly unspecified, but it is preferably an acute angle of about 90° or lower. Further, in a case of the metal sheet material having magnetism, such a sheet metal is difficult to easily bend and process. As a result, in the present invention a metal sheet material having no magnetism constitutes the developing blade 54, so that in developing blade 54 it is easy to form a bending section 55 by a bending and processing. The use of a developing blade 54 with such a bending section 55 provides significant advantages in the device of the present invention. More specifically, the use of such a developing blade 54 with a bending section 55 allows the developing blade 54 to have a consistent contact with the developing roller 49, even if there is a slight mispositioning of the developing blade 54.

More specifically, FIG. 1(*b*) illustrates the bending section 55 of developing blade 54 of the present invention contacting developing roller 49 to uniformly control formation of a toner layer on the developing roller 49 to be uniform even with a deviation in a position of the developing blade 54. As shown in FIG. 1(*b*), a minute space C is formed between the bending section R of the blade 54 and an outer circumference B of the developing roller 49. In the present invention, the size of minute space C is not changed if the bending section R is in contact with the outer circumference of the developing blade. When the tip portion of the blade changes to 54' illustrated by the dotted line in FIG. 1(*b*), for example, the minute space C between the bending section R' of the blade 54' and the developing roller 49 is maintained to be the same. As a result, in the present invention, a deviation in the positioning of developing blade 54, which determines the toner volume passing through the contacting position of the developing blade 54 and the developing roller 49, is not critical. Accordingly, the regulated toner layer is uniform because of stably maintaining the minute space C. As a result, in mass production of the developing unit of the present invention by constructing a variety of parts, each developing unit can regulate the toner layer to a predetermined thickness because of a sufficient tolerance in setting the positioning of the developing blade 54.

Figure 3:
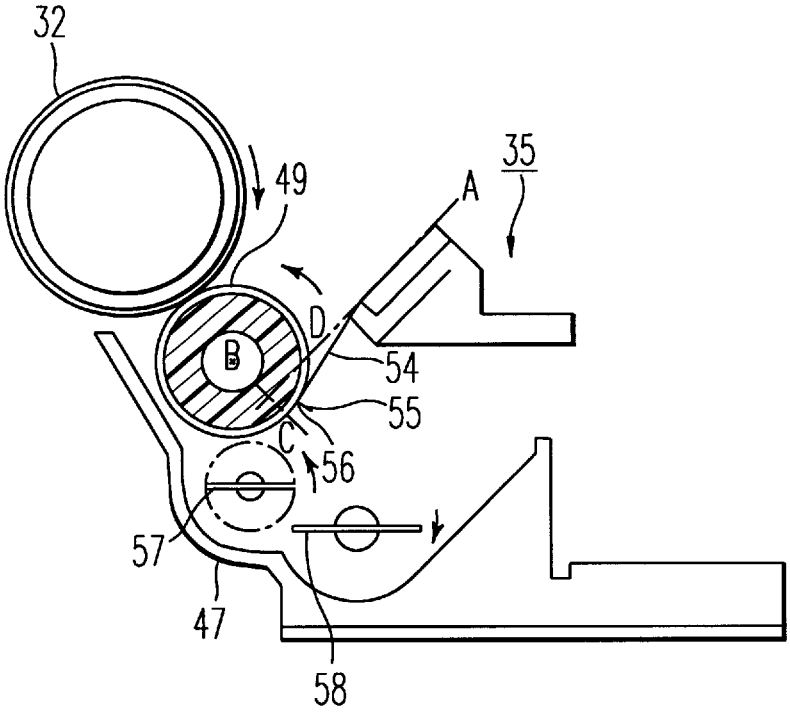
FIG. 3 is a front schematic view of a developing unit for describing an arranged and installed position of a developing blade.

Further, in the present invention the contacting section 56 is positioned, as illustrated in FIG. 3, so that the contacting section 56 is downstream in the rotating direction of developing roller 49 from the crossing point C, which is a perpendicular intersection of an extension of a vertical line from a center of the developing roller 49 to an extension of an installed line of fixing surface A of the developing blade 54 and the outer circumference surface of the developing roller 49. The contacting section 56 is also positioned upstream in the rotating direction of developing roller 49 from crossing point D of the extension of the installed line of fixing surface A of the developing blade 54 and the outer circumference surface of developing roller 49. In other words, the contacting section 56 is positioned between crossing points C and D.

Further, in the developing container 47, a toner supplying plate 57, which serves as an agitating member, is installed just upstream of the contacting section 56 between the developing roller 49 and the developing blade 54, or more concretely, at a position nearly just under the developing roller 49. An agitator 58 is also installed between the toner supplying plate 57 and the opening 46. The toner supplying plate 57 and agitator 58 are formed throughout a whole longitudinal extent of the developing roller 49, and are supported axially to freely rotate. The toner supplying plate 57 may be formed by a sheet metal or resin, etc., but in one embodiment, as an example, is formed of metal sheets.

Figure 4:
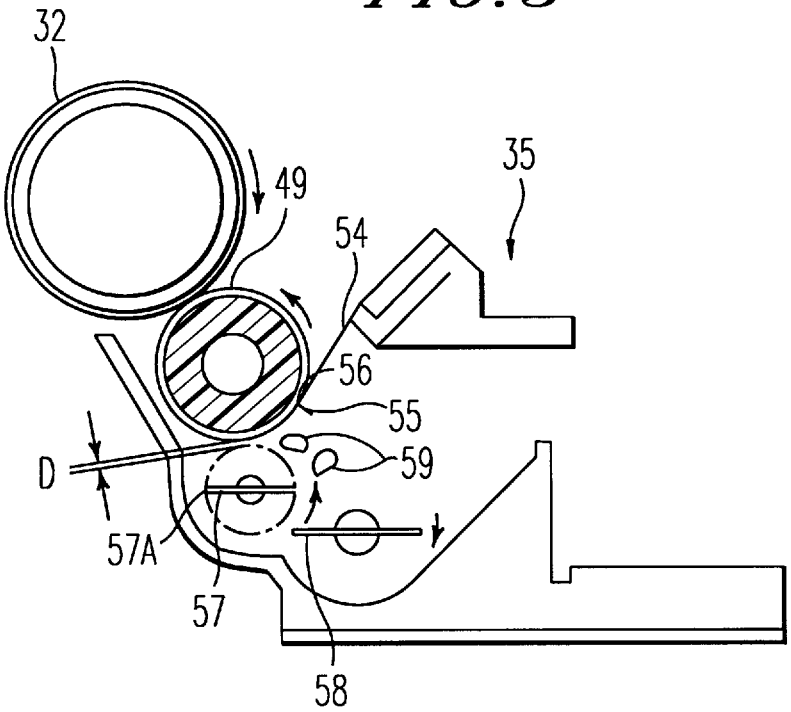
FIG. 4 is a front schematic view of a developing unit for describing an arranged and installed position of a toner supplying plate.
Figure 5:
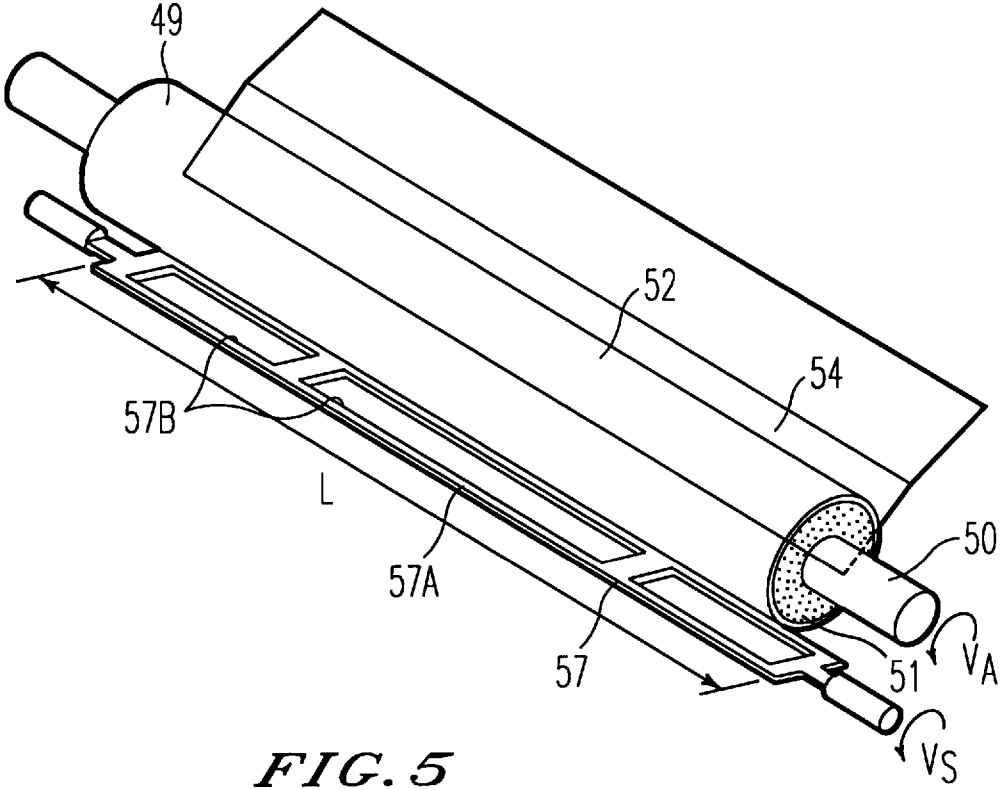
FIG. 5 is a perspective view showing a shape of a toner supplying plate.
Figure 6:
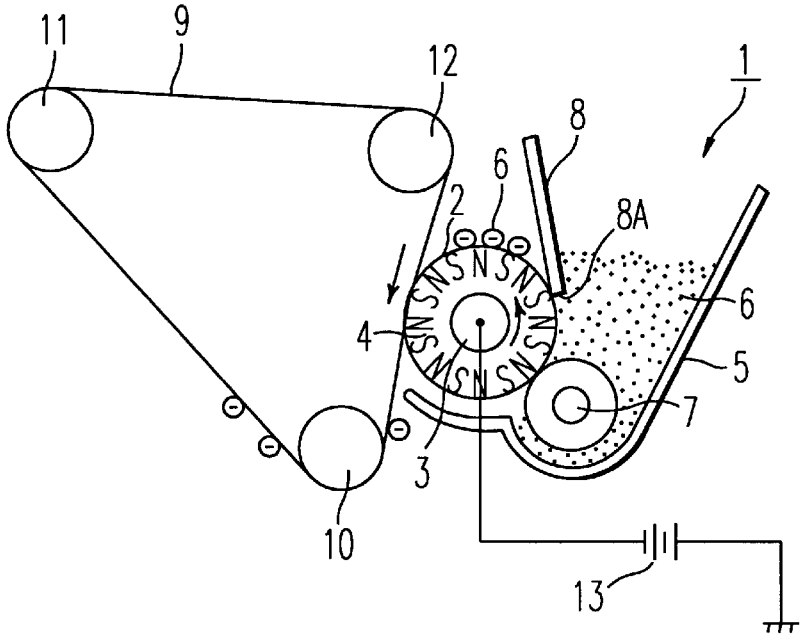
FIG. 6 BACKGROUND ART
FIG. 6 is a front schematic view of a background embodiment using a belt shaped sensitive body.
Figure 7:
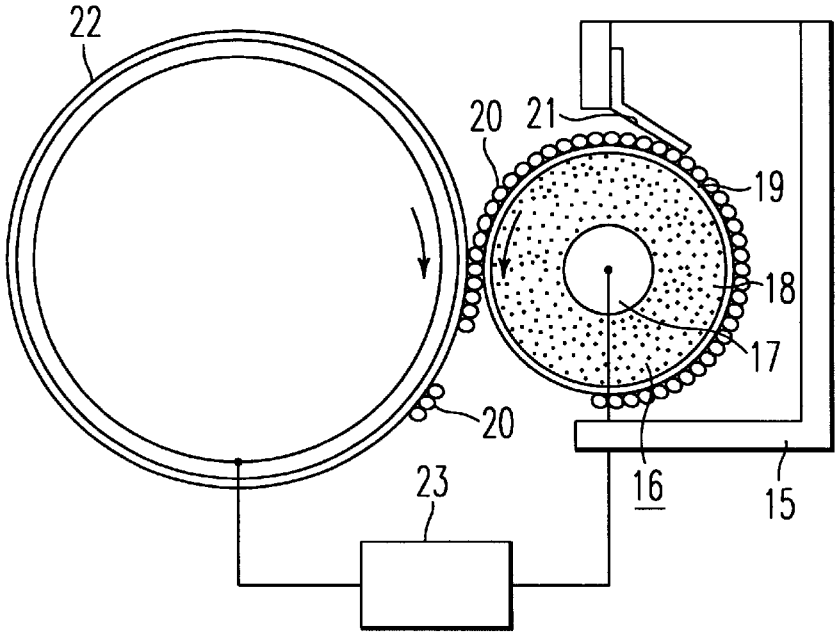
FIG. 7 BACKGROUND ART
FIG. 7 is a front schematic view of a background embodiment using a developing roller.
Figure 8:
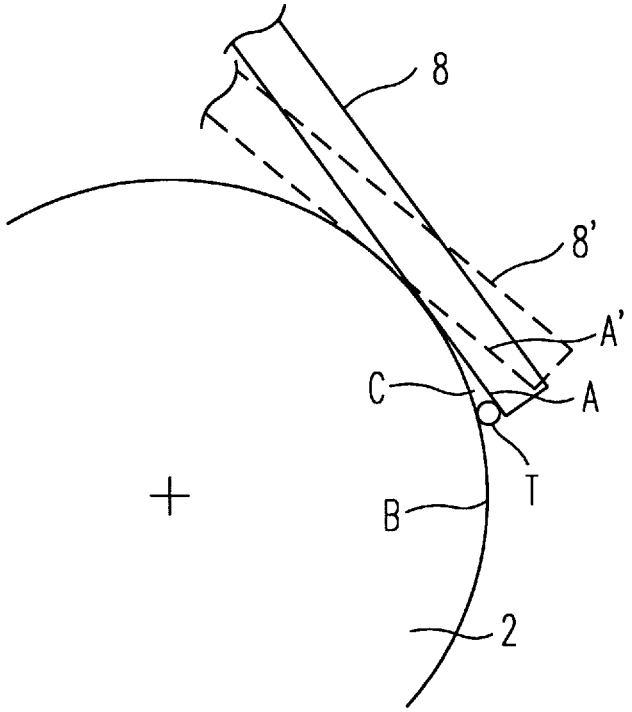
FIG. 8 BACKGROUND ART
FIG. 8 shows a detail of the use of a straight blade in the background embodiments.

The toner supplying plate 57 forms, as illustrated in FIG. 5, an opening 57*b* appropriately on a member section forming an effective agitating section 57*a* in which its length L is longer than a length of an effective image space. Further, the toner supplying plate 57 is rotated and driven in a same direction as the developing roller 49 by a rotating drive system (not shown). However, in this case, the toner supplying plate 57 is arranged and installed adjacent to the developing roller 49 so that the rotating outer circumference of the effective agitating section 57*a* does not contact the outer circumference of the developing roller 49. More concretely, the supplying plate 57 is positioned so that a clearance gap d, see FIG. 4, between the rotating outer circumference of the effective agitating section 57*a* and the outer circumference of the developing roller 49 is 2 mm or less. Also, as mentioned later in detail, when setting Vd for a speed of rotating the outer circumference of developing roller 49, Vs for a speed of rotating the outer circumference of effective agitating section 57*a* of the toner supplying plate 57, a speed relationship between these two speeds is set to be $Vd \leqq Vs$.

In such a construction, toner, e.g., one component magnetic toner, is supplied to the side of agitator 58 from a hopper through the opening 46. The toner supplied to the side of the agitator 58 is agitated and conveyed to the side of developing roller 49 by the rotation and driving of agitator 58 and supplying plate 57, and attaches on the developing roller 49 as a toner layer. This attachment is produced from the magnetism of the magnetic field generating layer 52 of the surface layer on the developing roller 49.

The clockwise rotation of developing roller 49 causes the toner layer to be regulated to the appropriate layer thickness when passing the contacting section 56 of the developing roller 49 elastically pressed and contacted by a specified pressure from the developing blade 54 on the surface of the developing roller 49. The rotation of developing roller 49 further allows the toner layer formed on the surface of developing roller 49 to be conveyed to the contact section 53 with the sensitive body 32, and to develop the electrostatic latent image on the sensitive body 32 formed by the optical writing element 34.

At this time, the toner developing volume necessary to generate the image on the transfer paper with a density of 1.4 or darker (or greater) by using a Macbeth densitometer is, for example, 0.8 mg/cm or more for one component magnetic toner. The Applicants of the present invention have found that the regulation of the thickness of the toner layer by the bending section 55 of the developing blade 54 having elastic and non-magnetic characteristics as illustrated in this embodiment of the present invention causes the toner volume maintained on the surface layer of the developing roller 49 to be stable at 0.6 through 1.0 mg/cm. In other words, in the present invention, even though the magnetic field generating layer 52 on the surface layer of the developing roller 49 has a pole pitch which is minute, the toner layer is still formed in a multilayer state on developing roller 49, i.e. a toner layer of adequate thickness can be formed on developing roller 49 even if the pole pitch on developing roller 49 is minute.

This means that in the present invention the developing roller 49 can supply a necessary and sufficient volume of toner to the sensitive body 32, even if a linear velocity of developing roller 49 is reduced to less than 1.5 times as fast as the linear velocity of sensitive body 32. This enables the image forming device of the present invention to develop an image having sufficient toner density.

Figure 9:
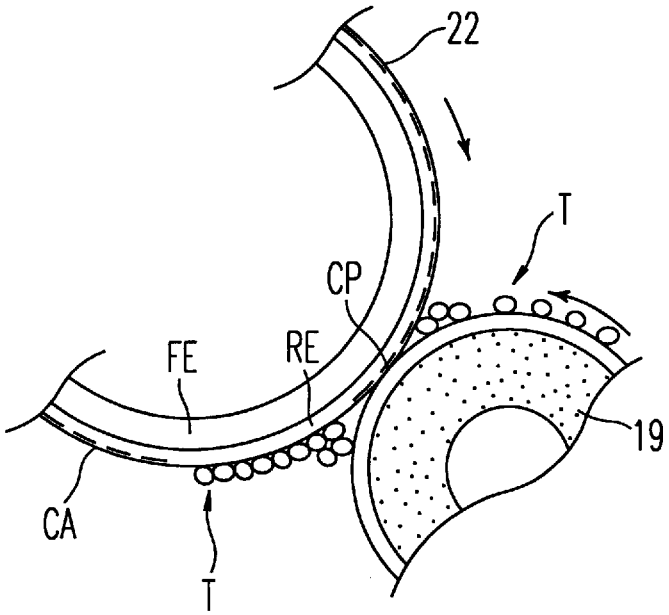
FIG. 9 BACKGROUND ART
FIG. 9 shows a generation of a toner deviation in the background embodiments.

Such reducing of the linear velocity of developing roller 49 also enables solving the problem of toner deviation as discussed above with respect to FIG. 9. Further, to reduce the linear velocity ratio of developing roller 49 to less than two times as fast as that of the sensitive body 32, the pole pitch of the magnetic field generating layer 52 may be miniaturized to 0.65 mm or less. Further, preferably reducing the linear velocity ratio to less than 1.5 times, the pole pitch of the magnetic field generating layer can be miniaturized to 0.49 mm or less. Such miniaturizing of the pole pitch of the magnetic field generating layer 52 is also possible owing to recent improvement of polarization devices. In other words, soft rollers could not be polarized with high density in the past, and it was a trend to use hard rollers, but currently rollers having flexibility and polarizability with high density are realized.

Further, the toner attached on the developing roller 49 by magnetism needs to be charged before being conveyed to the sensitive body 32, and is charged by friction when passing the developing blade 54. Applicants of the present invention have found that forming the contacting section 56 between the developing blade 54 and developing roller 49 at the bending section 55, not at a point edge of developing blade 54, and making the radius of curvature R of the bending section 55 0.3 mm or larger (preferably 0.3 to 0.5 mm), causes the volume of toner maintained on the developing roller 49 and the quantity of electricity charged thereon to be stable.

Further, the Applicants of the present invention have recognized that the unevenness in a toner supplying volume becomes large according to the accuracy of the position of installing the developing blade. The shape of developing blade 54 in the present invention alleviates such a problem. Further, in the present invention, the position of the contacting section 56 with the bending section 55 is established at a point downstream in a rotating direction from the crossing point C which, as Applicants have recognized, allows the elastic contacting state of the bending section 55 to be stable, and thereby allows the toner supplying volume to be stable. Particularly, forming the developing blade 54 with a non-magnetic material enables forming a toner layer of a multilayer with high evenness and without vibration, by being attracted by the pole of magnetic field generating layer 52 on the surface layer of developing roller 49.

Further, establishing the position of the contacting section 56 at a point upstream in the rotating direction from the crossing point C allows the toner supplying volume by the developing roller 49 to be excessive and the thickness of the toner layer not to be regulated. Particularly, when passing such a position, the toner supplying volume on the developing roller 49 is liable to be excessive, which is unpreferable. The position of the contacting section 56 depends on the roller radius of developing roller 49, but according to the results of experiments conducted by the Applicants, its positioning at a point 2 mm or less on an outside from the extended line on face A of installing the developing blade 54 results in obtaining a favorable regulating action of the toner layer thickness by developing blade 54.

Further, the utilization of the toner supplying plate 57 also contributes to forming a multilayer toner layer or developing roller 49, and a multilayer which has a uniform thickness.

Further, in the present invention toner, e.g. one component magnetic toner, is supplied from the toner hopper via agitator 58 to the surface of developing roller 49. Actions of agitating and supplying the toner with the toner supplying plate 57 at a point just upstream in the rotating direction from the contacting section 56 between the developing roller 49 and developing blade 54 allows the toner to be sufficiently supplied to the contacting section 56, which further results in the toner multilayer.

Also, when considering time consumed, toner agglomerate 59 may be formed in the developing container 47 as illustrated in FIG. 4. When such toner agglomerate 59 is conveyed to the contacting section 56 just as it is, the developing blade 54 may not operate effectively and a possible uneven thickness of the toner layer may result, and at the same time such toner agglomerate 59 may be conveyed to the sensitive body 32 just as it is, and may detrimentally be used for developing.

On this point, the rotation and driving of toner supplying plate 57 at the point just upstream of the contacting section 56 causes toner agglomerate 59, if any, to be agitated by the toner supplying plate 57 and to be fractured in the small space between the toner supply plate 57 and developing roller 49, which enables the toner to be supplied in a stable state without agglomerate. Particularly, an effective agitating section 57*a* of the toner supplying plate 57 is longer than an effective image space, so that the toner can be supplied evenly without any agglomerate throughout the space of the entire length to the axial direction of developing roller 49, which enables the toner blade 54 to demonstrate its maximum capability for unifying the thickness of the toner layer on developing roller 49.

Further, the toner agglomerate 59 is effectively fractured because in the present invention the speed Vs of rotating the outer circumference of an effective agitating section 57*a* is higher than the speed Vd of rotating the outer circumference of the developing roller 49. At the same time, because the effective agitating section 57*a* never contacts the developing roller 49, the toner supplying plate 57 never damages the developing roller 49. However, since the gap d between agitator 57 and developing roller 49 is d=2 mm or less, the ability of agitator 57 to minutely fracture the agglomerate 59 becomes higher.

The present invention is based on Japanese Patent Applications 07-195335 and 07-195336, both filed on Jul. 31, 1995, and each incorporated herein by reference.

Obviously, numerous additional modifications and variations of the present invention are possible in light of the above teachings. It is therefore to be understood that within the scope of the present invention, the present invention may be practiced otherwise than as specifically disclosed herein.

What is claimed as new and is desired to be secured by Letters Patent of the United States is:

1. An image forming device comprising:

an electrophotoconductive member on which an electrostatic latent image is formed;

a developing roller, including an elastic body layer and a magnetic field generating layer overlying said elastic body layer and having a predetermined pitch of magnetic poles, said developing roller contacting said electrophotoconductive member at a contacting section and developing said electrostatic latent image by conveying toner to a surface of said electrophotoconductive member; and an elastic toner regulating blade having a bending section at an end, for regulating a thickness of a toner layer on the developing roller by the bending section elastically contacting a surface of said developing roller at a contact point upstream, in a rotating direction of said developing roller, from the contacting section of said developing roller and said electrophotoconductive member.

2. The image forming device of claim 1, wherein a radius of curvature of said bending section of said toner regulating blade is at least 0.3 mm.

3. The image forming device of claim 1, wherein the contact point of said developing roller and said bending section of said toner regulating blade is also upstream relative to a rotation direction of the developing roller from an intersection of an extension of an installed line of said toner regulating blade and an outer circumference of said developing roller, and is also downstream relative to the rotation direction of the developing roller from an intersection of an extension of a vertical line from a center of said developing roller to the extension of the installed line of said toner regulating blade and the outer circumference of said developing roller.

4. The image forming device of claim 2, wherein the contact point of said developing roller and said bending section of said toner regulating blade is also upstream relative to a rotation direction of the developing roller from an intersection of an extension of an installed line of said toner regulating blade and an outer circumference of said developing roller, and is also downstream relative to the rotation direction of the developing roller from an intersection of an extension of a vertical line from a center of said developing roller to the extension of the installed line of said toner regulating blade and the outer circumference of said developing roller.

5. The image forming device of claim 1, further comprises an agitator for agitating and supplying toner to said developing roller, said agitator including a toner supplying plate positioned upstream relative to a rotation direction of the developing roller of the contact point of said developing roller and said toner regulating blade so that an outer circumference of said toner supplying plate does not contact an outer circumference of said developing roller.

6. The image forming device of claim 5, wherein a rotating speed of said toner supplying plate is higher than a rotating speed of said developing roller.

7. The image forming device of claim 5, wherein a minimum gap between an outer surface of said agitator and an outer surface of said developing roller is less than 2 mm.

8. The image forming device of claim 5, wherein said toner supplying plate comprises at least one opening.

9. The image forming device of claim 1, wherein a pitch between N-magnetic poles and S-magnetic poles of said magnetic field generating layer of said developing roller is less than 0.65 mm.

10. The image forming device of claim 1, wherein a rotating speed ratio of an outer circumference of said developing roller to an outer circumference of said electrophotoconductive member is less than 2.0.

11. The image forming device of claim 9, wherein a rotating speed ratio of an outer circumference of said developing roller to an outer circumference of said electrophotoconductive member is less than 2.0.

12. The image forming device of claim 1, wherein a bending angle of said bending section of said toner regulating blade is less than 90°.

13. The image forming device of claim 2, wherein a bending angle of said bending section of said toner regulating blade is less than 90°.

14. The image forming device of claim 1, wherein said toner regulating blade is made of a non-magnetizable material.

15. The image forming device of claim 13, wherein said toner regulating blade is made of a non-magnetizable material.

16. The image forming device of claim 1, wherein said developing roller is a drum including an elastic layer having a JIS A hardness less than 70°.

17. An image forming device comprising:

an electrophotoconductive means on which an electrostatic latent image is formed;

a developing means including an elastic body and a magnetic field generating means overlying said elastic body and having a predetermined pitch of magnetic poles, for contacting said electrophotoconductive means at a contacting section and developing said electrostatic latent image by conveying toner to a surface of said electrophotoconductive means; and a toner regulating means having a bending section at an end, for regulating a thickness of a toner layer on the developing means by the bending section elastically contacting a surface of said developing means at a contact point upstream, in a rotating direction of said developing means, from the contacting section of said developing means and said electrophotoconductive means.

18. The image forming device of claim 17, wherein a radius of curvature of said bending section of said toner regulating means is at least 0.3 mm.

19. The image forming device of claim 17, wherein the contact point of said developing means and said bending section of said toner regulating means is also upstream relative to a rotation direction of the developing means from an intersection of an extension of an installed line of said toner regulating means and an outer circumference of said developing means, and is also downstream relative to the rotation direction of the developing means from an intersection of an extension of a vertical line from a center of said developing means to the extension of the installed line of said toner regulating means and the outer circumference of said developing means.

20. The image forming device of claim 18, wherein the contact point of said developing means and said bending section of said toner regulating means is also upstream relative to a rotation direction of the developing means from an intersection of an extension of an installed line of said toner regulating means and an outer circumference of said developing means, and is also downstream relative to the rotation direction of the developing means from an intersection of an extension of a vertical line from a center of said developing means to the extension of the installed line of said toner regulating means and the outer circumference of said developing means.

21. The image forming device of claim 17, further comprises agitating means for agitating and supplying toner to said developing means, said agitating means including a toner supplying means positioned upstream relative to a rotation direction of the developing means of the contact of said developing means and said toner regulating means so that an outer circumference of said toner supplying means does not contact an outer circumference of said developing means.

22. The image forming device of claim 21, wherein a rotating speed of said toner supplying means is higher than a rotating speed of said developing means.

23. The image forming device of claim 21, wherein a minimum gap between an outer surface of said agitating means and an outer surface of said developing means is less than 2 mm.

24. The image forming device of claim 21, wherein said toner supplying means comprises at least one opening.

25. The image forming device of claim 17, wherein a pitch between N-magnetic poles and S-magnetic poles of said magnetic field generating means of said developing means is less than 0.65 mm.

26. The image forming device of claim 17, wherein a rotating speed ratio of an outer circumference of said developing means to an outer circumference of said electrophotoconductive means is less than 2.0.

27. The image forming device of claim 25, wherein a rotating speed ratio of an outer circumference of said developing means to an outer circumference of said electrophotoconductive means is less than 2.0.

28. The image forming device of claim 17, wherein a bending angle of said bending section of said toner regulating means is less than 90°.

29. The image forming device of claim 18, wherein a bending angle of said bending section of said toner regulating means is less than 90°.

30. The image forming device of claim 17, wherein said toner regulating means is made of a non-magnetizable material.

31. The image forming device of claim 29, wherein said toner regulating means is made of a non-magnetizable material.

32. The image forming device of claim 17, wherein said developing means is a drum including an elastic layer having a JIS A hardness less than 70°.

* * * * *